US012790735B2

(12) United States Patent
Cho et al.

(10) Patent No.: US 12,790,735 B2
(45) Date of Patent: Nov. 10, 2026

(54) GARMENT PROCESSING DEVICE

(71) Applicant: LG Electronics Inc., Seoul (KR)

(72) Inventors: Hongjun Cho, Seoul (KR); Jongmin Lee, Seoul (KR); Hyojun Kim, Seoul (KR); Yongjun An, Seoul (KR)

(73) Assignee: LG Electronics Inc., Seoul (KR)

( * ) Notice: Subject to any disclaimer, the term of this patent is extended or adjusted under 35 U.S.C. 154(b) by 338 days.

(21) Appl. No.: 18/686,298

(22) PCT Filed: Aug. 22, 2022

(86) PCT No.: PCT/KR2022/012527

§ 371 (c)(1),
(2) Date: Feb. 23, 2024

(87) PCT Pub. No.: WO2023/027455

PCT Pub. Date: Mar. 2, 2023

(65) Prior Publication Data

US 2026/0132564 A1 May 14, 2026

(30) Foreign Application Priority Data

Aug. 24, 2021 (KR) ..... 10-2021-0111967

(51) Int. Cl.
*D06F 37/40* (2006.01)
*D06F 58/06* (2006.01)
(Continued)

(52) U.S. Cl.
CPC ..... *D06F 37/40* (2013.01); *D06F 58/06* (2013.01); *D06F 58/08* (2013.01); *D06F 58/20* (2013.01); *D06F 58/263* (2013.01)

(58) Field of Classification Search
CPC ..... D06F 37/40; D06F 58/06; D06F 58/08; D06F 58/20; D06F 58/263; D06F 37/26
See application file for complete search history.

(56) References Cited

U.S. PATENT DOCUMENTS 12,655,568 B2 * 6/2026 An ..... D06F 37/304
2024/0352655 A1 * 10/2024 Cho ..... D06F 37/40
(Continued)

FOREIGN PATENT DOCUMENTS

CN 104963170 B 1/2017
CN 211670752 U 10/2020
(Continued)

OTHER PUBLICATIONS

Notice of Allowance in Korean Appln. No. 10-2021-0111967, mailed on Oct. 18, 2024, 2 pages (with English translation).
(Continued)

*Primary Examiner* — David J Laux
(74) *Attorney, Agent, or Firm* — Fish & Richardson P.C.

(57) ABSTRACT

The present application relates to a garment processing device comprising: a drum comprising a drum body for providing a garment storage space, a front cover forming the front surface of the drum body, a rear cover forming the rear surface of the drum body, and a drum introduction opening provided through the front cover; a fixed panel positioned to be spaced apart from the rear cover and provided with a guide hole; a mounting body inserted into the guide hole to be able to reciprocate in a direction perpendicular to the fixed panel, the mounting body being divided into a first area facing in a direction in which the rear cover is positioned with reference to the fixed panel and a second area positioned opposite to the first area; a head provided in the first area to prevent the mounting body from being separated from the fixed panel; a power transfer portion comprising a housing fixed in the second area, an input shaft having one end positioned outside the housing and having the other side positioned inside the housing, an output shaft having one end fixed to the rear cover through the fixed panel and having the other end positioned inside the housing, and a
(Continued)

gear unit positioned inside the housing so as to transfer rotational movements from the input shaft to the output shaft; a stator fixed in the second area or the housing so as to form a rotating field; a rotor, to which one end of the input shaft is fixed, and which is rotated by the rotating field; and a first displacement limiter provided in the second area to be positioned between the fixed panel and the housing, thereby limiting the displacement of the housing toward the fixed panel.

12 Claims, 10 Drawing Sheets

(51) Int. Cl.

| | |
|---|---|
| ***D06F 58/08*** | (2006.01) |
| ***D06F 58/20*** | (2006.01) |
| ***D06F 58/26*** | (2006.01) |

(56) References Cited

U.S. PATENT DOCUMENTS

| | | | | |
|---|---|---|---|---|
| 2024/0352656 | A1* | 10/2024 | Kim | D06F 58/08 |
| 2024/0376655 | A1* | 11/2024 | An | D06F 37/304 |

FOREIGN PATENT DOCUMENTS

| | | | |
|---|---|---|---|
| JP | 2004-216166 | | 8/2004 |
| JP | 2010-057816 | | 3/2010 |
| JP | 2012-235851 | A | 12/2012 |
| KR | 10-0480928 | B1 | 4/2005 |
| KR | 10-2005-0067263 | A | 7/2005 |
| KR | 10-2005-0120977 | | 12/2005 |
| KR | 10-2006-0100673 | A | 9/2006 |
| KR | 10-2020-0065932 | | 6/2020 |
| KR | 10-2020-0066169 | | 6/2020 |

OTHER PUBLICATIONS

Office Action in Japanese Appln. No. 2024-512187, mailed on Dec. 3, 2024, 5 pages (with English Translation).

International Search Report and Written Opinion in International Appln. No. PCT/KR2022/012527, mailed on Dec. 2, 2022, 17 pages (with English translation).

Office Action in Korean Appln. No. 10-2021-0111967, mailed on Mar. 9, 2024, 11 pages (with English translation).

Extended European Search Report in European Appln. No. 22861665.2, mailed on Jul. 11, 2025, 5 pages.

Notice of Allowance in Japanese Appln. No. 2024-512187, mailed on May 13, 2025, 5 pages (with English translation).

* cited by examiner

GARMENT PROCESSING DEVICE

CROSS-REFERENCE TO RELATED APPLICATIONS

This application is a National Stage application under 35 U.S.C. § 371 of International Application No. PCT/KR2022/012527, filed on Aug. 22, 2022, which claims the benefit of Korean Application No. 10-2021-0111967, filed on Aug. 24, 2021. The disclosures of the prior applications are incorporated by reference in their entirety.

TECHNICAL FIELD

The present disclosure relates to a laundry treating apparatus.

BACKGROUND

A laundry treating apparatus is a general term for a washing machine that washes laundry (an object-to-be-washed or dried), a dryer that dries the laundry, and an apparatus that may perform both the washing and the drying of the laundry.

It was common that the washing machine is equipped with a tub in which water is stored, a washing drum that is disposed inside the tub and stores the laundry therein, and a driver (a washing driver) that rotates the washing drum, and the dryer is equipped with a drying drum in which the laundry is stored, a driver (a drying driver) that rotates the drying drum, and a heat exchanger that supplies air to the drying drum to remove moisture from the laundry.

It was common that the washing driver is equipped with a stator that is fixed to the tub and generates a rotating field, a rotor that rotates by the rotating field, and a rotation shaft that extends through the tub and connects the washing drum with the rotor, while the drying driver is equipped with a motor, a pulley fixed to a rotation shaft of the motor, and a belt (a power transmitter) that connects a rotating motion of the pulley to the drying drum.

The washing driver is equipped such that the rotation shaft of the motor connects the washing drum with the rotor. To wash or dehydrate the laundry, the washing driver needs to control the number of rotations of the washing drum to be great or change a rotation direction of the washing drum. When the rotation shaft of the motor is constructed to directly connect the washing drum with the rotor, the number of rotations and the rotation direction of the washing drum are able to be easily controlled.

On the other hand, it was common that the existing drying driver has a structure in which the power transmitter such as the belt connects the drying drum with the rotation shaft of the motor. This is because, in the dryer, it is allowed to rotate the drying drum via the power transmitter such as the belt as there is little need to keep the number of rotations of the drying drum great or change a rotation direction of the drying drum. However, when the number of rotations and the rotation direction of the drying drum are able to be changed, a movement of the laundry inside the drying drum will be able to be controlled, so that the dryer is also able to expect a reduction in a drying time and an improved drying performance.

Among the existing dryers, there is one equipped with the drying driver that connects the rotor with the drying drum via a reducer (the power transmitter) (Publication No. 10-2020-0065931). The drying driver is equipped such that an input shaft connected to the rotor and an output shaft connected to the drying drum are coaxial, so that the reduction in the drying time and the improved drying performance may be expected. However, it is difficult to assemble the drying drum with the output shaft of the reducer, and durability reduction of the reducer or the drying drum (a damage to a bolt disposed in the reducer, a damage to the output shaft, a damage to the drying drum, and the like) may occur when assembling the drying drum with the output shaft.

DISCLOSURE

Technical Problem

An object of the present disclosure is to provide a laundry treating apparatus that minimizes a decrease in durability of a power transmitter.

An object of the present disclosure is to provide a laundry treating apparatus in which an output shaft of a power transmitter and a drum are easily assembled.

Technical Solution

According to an embodiment of the present disclosure, a laundry treating apparatus includes a drum including a drum body providing a space for storing laundry therein, a front cover forming a front surface of the drum body, a rear cover forming a rear surface of the drum body, and a drum inlet formed to pass through the front cover, a fixed panel apart from the rear cover and including a guide hole, a mounting body inserted into the guide hole, reciprocating in a direction perpendicular to the fixed panel, and is divided into a first region facing a position at which the rear cover is located and a second region located at an opposite side to the first region based on the fixed panel, a head provided in the first region and configured to prevent the mounting body from being separated from the fixed panel, a power transmitter including a housing fixed to the second region, an input shaft with one end located outside the housing and another end located inside the housing, an output shaft with one end formed to pass through the fixed panel and fixed to the rear cover and another end located inside the housing, and a gear unit located inside the housing and configured to transmit a rotating motion of the input shaft to the output shaft, a stator fixed to the second region or the housing to form a rotating field, a rotor fixed at one end of the input shaft and rotated by the rotating field, and a first displacement limiter provided in the second region to be located between the fixed panel and the housing and configured to limit a displacement in which the housing moves toward the fixed panel.

The first displacement limiter may include rubber.

One end of rubber may be fixed to the fixed panel, and another end of the rubber may be fixed to the housing.

The first displacement limiter may include a spring.

One end of the spring may be fixed to the fixed panel, and another end of the spiring may be fixed to the housing Two or more mounting bodies may be provided, and the mounting bodies may be apart from each other by a constant angle with respect to a through hole of the fixed panel.

A number of the first displacement limiters may be equal to a number of the mounting bodies.

The laundry treating apparatus may further include a second displacement limiter provided in the first region, located between the head and the fixed panel, and configured to limit a displacement in which the housing moves away from the fixed panel.

The second displacement limiter may include rubber or a spring.

The laundry treating apparatus may further include a rear cover through hole formed to pass through the rear cover, a shaft fastening portion fixed to the rear cover to close the rear cover through hole and including a first fastening body fixed to the rear cover, a second fastening body located within the drum, a fastening portion through-hole provided in the second fastening body, and a connecting body inserted into the rear cover through hole and connecting the first fastening body to the second fastening body, a fastening portion through-hole that is formed to pass through the shaft fastening portion and into which one end of the output shaft is inserted, and a nut coupled to one end of the output shaft formed to pass through the fastening portion through-hole and configured to fix the output shaft to the shaft fastening portion.

A diameter of the connecting body may be set to decrease toward the second fastening body from the first fastening body.

The laundry treating apparatus may further include a fastening portion cover located within the drum to close the rear cover through hole and configured to prevent the shaft fastening portion from being exposed into the drum.

The laundry treating apparatus may further include a cover through hole formed to pass through the fastening portion cover, a fastening groove provided in the output shaft, and a bolt inserted into the cover through hole, fixed to the fastening groove, and configured to fix the fastening portion cover to the output shaft.

Advantageous Effects

The present disclosure provides a laundry treating apparatus that may minimize a decrease in durability of a reducer.

The present disclosure provides a laundry treating apparatus in which an output shaft of a reducer and a drum are easily assembled.

DETAILED DESCRIPTION

Hereinafter, an embodiment of a laundry treating apparatus will be described in detail with reference to the attached drawings.

Figure 1:
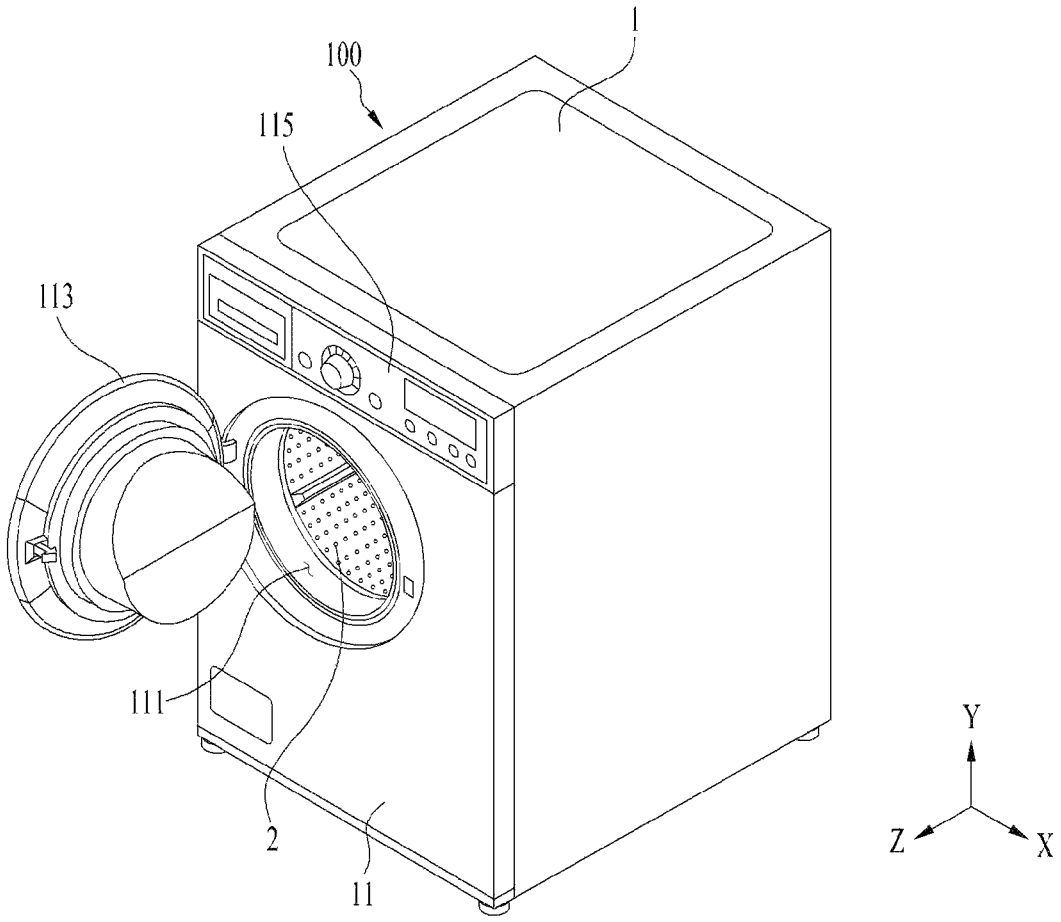
FIG. 1 shows an example of a laundry treating apparatus.
Figure 2:
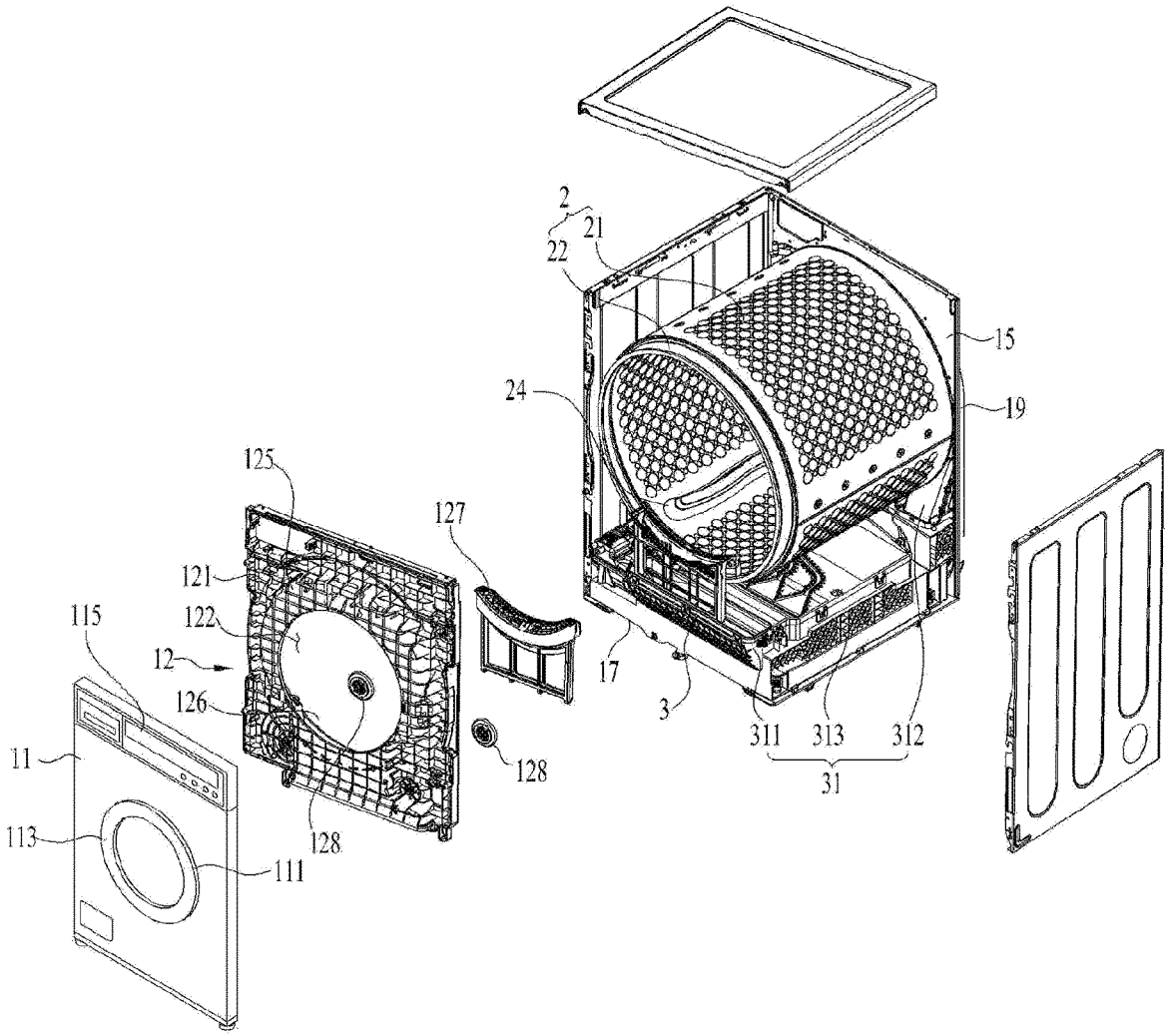
FIG. 2 shows a structure of a cabinet and an example of a support panel.

FIG. 1 shows an example of a laundry treating apparatus 100. The laundry treating apparatus 100 may include a cabinet 1 and a drum 2 that is rotatably disposed inside the cabinet and provides a space in which laundry (an object-to-be-washed or an object-to-be-dried) is stored. As shown in FIG. 2, inside the cabinet 1, a dryer 3 that supplies high-temperature dry air (air with a temperature higher than a room temperature and air with a dryness higher than that of indoor air) to the drum 2 and removes moisture from the laundry may be disposed.

As shown in FIG. 2, the cabinet 1 includes a front panel 11 constituting a front surface of the laundry treating apparatus, and a base panel 17 constituting a bottom surface of the laundry treating apparatus. The front panel 11 has an inlet 111 defined therein that is in communication with the drum 2, and the inlet 111 is able to be closed by a door 113.

The front panel 11 has a control panel 115, which may include an input unit that receives a control command from a user and a display that outputs information such as a control command selectable by the user. The input unit may include a power supply request unit that requests power supply to the laundry treating apparatus, a course input unit that allows the user to select a desired course among multiple courses, and an execution request unit that requests start of the course selected by the user.

Figure 3:
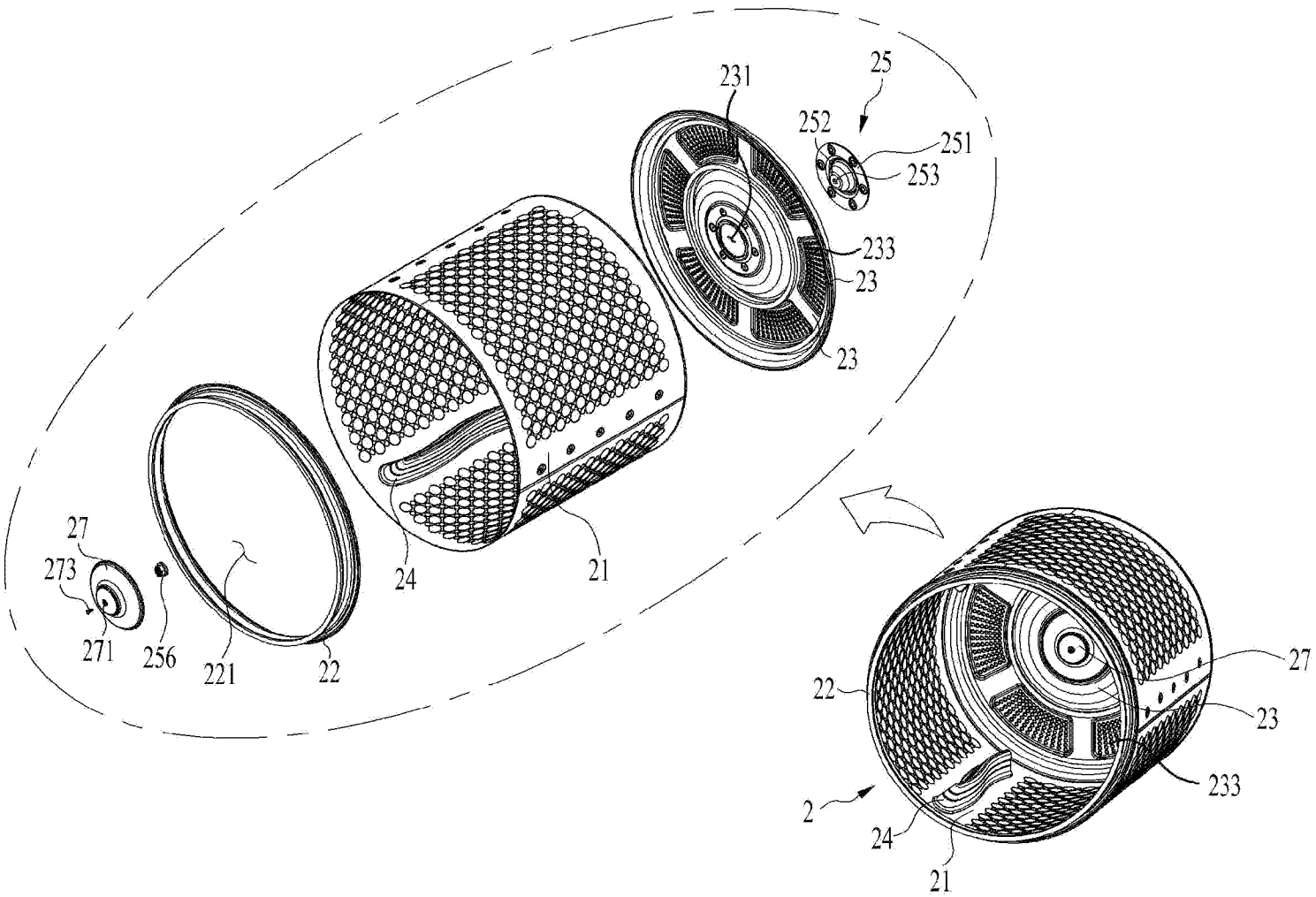
FIG. 3 shows an example of a drum.

The drum 2 may be formed in a hollow cylindrical shape. As shown in FIG. 3, the drum 2 may be formed to include a cylindrical drum body 21 with open front and rear surfaces, a front cover 22 that forms a front surface of the drum body 21, and a rear cover 23 that forms a rear surface of the drum body 21.

The front cover 22 may have a drum inlet 221 that allows the inside of the drum body 21 to be in communication with the outside, and the rear cover 23 may have an air inlet 233 that introduces outside air into the drum body 21.

The drum body 21 may further have a lifter 24. The lifter 24 is means of causing the laundry to repeatedly ascend and descend inside the drum. The lifter 24 may be formed such that a board extending from the front cover 22 toward the rear cover 23 protrudes from the drum body 21 toward a center of rotation of the drum 2 (protrudes from a circumferential surface of the drum toward the center of rotation of the drum).

When the laundry treating apparatus 100 is constructed as an apparatus only for drying the laundry, the drum 2 does not have to include drum through-holes that are defined to extend through the drum body 21 to allow the inside of the drum to be in communication with the outside of the drum.

Figure 4:
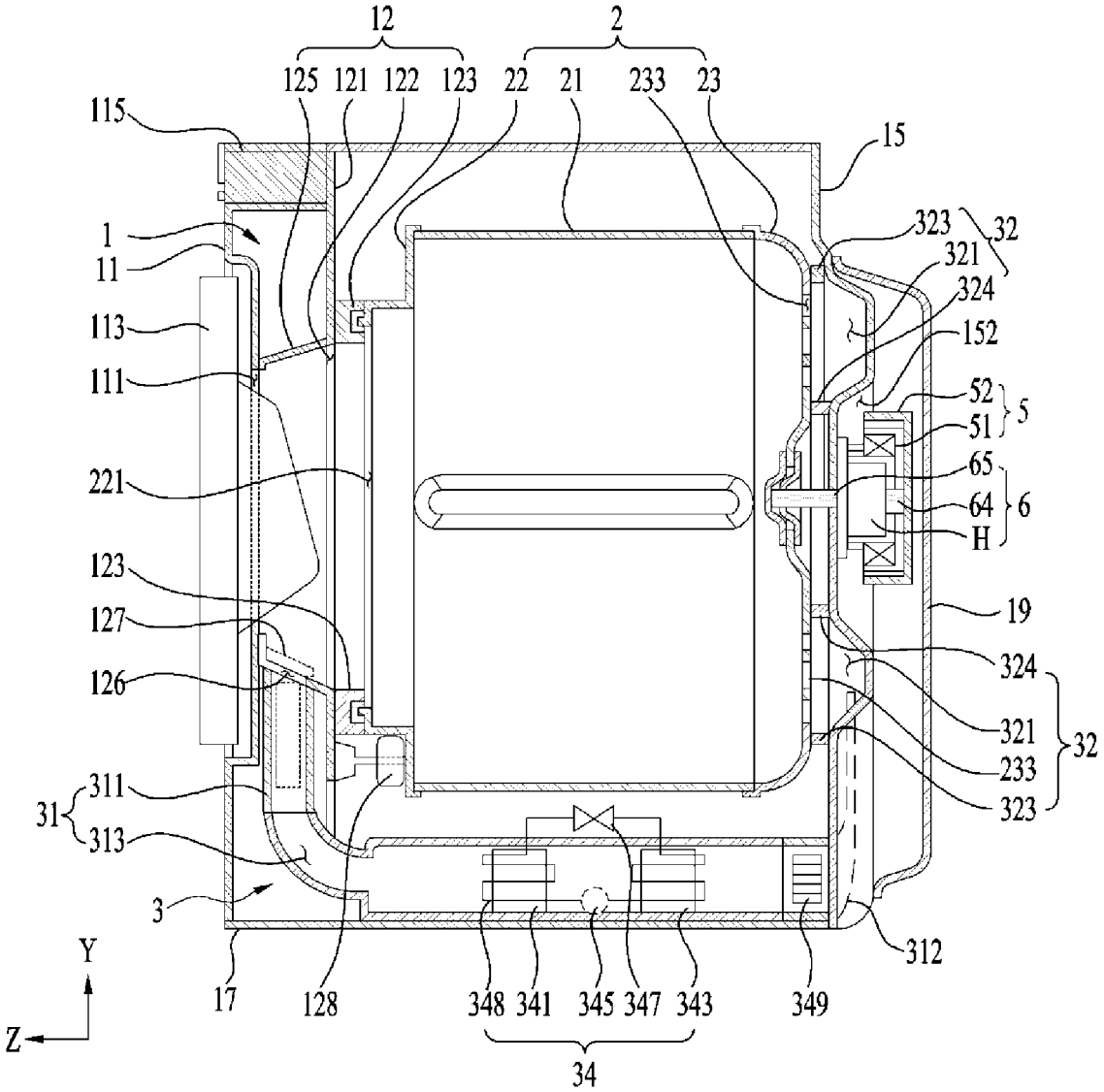
FIG. 4 shows an example of a dryer.

As shown in FIG. 4, the above-described drum 2 may be rotatably fixed to at least one of a first body support 12 and a second body support 15. FIG. 4 shows a case in which the rear cover 23 is rotatably fixed to the second body support 15 via a power transmitter 6, which will be described later, and the front cover 22 is rotatably connected to the first body support 12 as an example.

The first body support 12 may be constructed as a support panel 121 fixed to the cabinet 1 and located between the front panel 11 and the front cover 22. The support panel 121 may be positioned between the front panel 11 and the front cover 22 by being fixed to the base panel 17. In this case, a rear surface (a surface facing the support panel) of the front panel 11 may be fixed to the support panel 121, and a lower end of the front panel 11 may be fixed to the base panel 17.

The support panel 121 may include a support panel through-hole 122, a drum connecting body 123 that connects the support panel through-hole 122 with the drum inlet 221, and a panel connecting body 125 that connects the support panel through-hole 122 with the inlet 111. The support panel through-hole 122 is defined to extend through the support panel 121 and allows the inlet 111 and the drum inlet 221 to be in communication with each other.

The drum connecting body 123 may be formed as a pipe fixed to a rear surface of the support panel 121 (a surface facing the drum inlet in a space provided by the support panel). One end of the drum connecting body 123 may surround the support panel through-hole 122, and a free end of the drum connecting body 123 may support the front cover 22. That is, the free end of the drum connecting body 123 may be inserted into the drum inlet 221, or may be in contact with a free end of the front cover 22 (an edge of the drum inlet) defining the drum inlet 221. FIG. 4 shows a case in which the free end of the drum connecting body 123 is in contact with the free end of the front cover 22 as an example.

The panel connecting body 125 may be formed as a pipe fixed to a front surface of the support panel 121 (a surface facing the front panel in the space provided by the support panel). One end of the panel connecting body 125 may surround the support panel through-hole 122, and the other end of the panel connecting body 125 may be connected to the inlet 111. Accordingly, the laundry supplied into the inlet 111 may move to the drum body 21 via the panel connecting body 125, the support panel through-hole 122, the drum connecting body 123, and the drum inlet 221.

The support panel 121 may have an exhaust port 126 that discharges air inside the drum 2 to the outside of the drum, and a filter 127 may be detachably fixed to the exhaust port 126. The filter 127 may have any structure as long as it may filter foreign substances from air flowing from the drum 2 to the exhaust port 126.

The support panel 121 may further include a drum support 128 that prevents the drum 2 from sagging. The drum support may be formed as a roller that is fixed to the support panel 121 and rotatably supports the drum 2. FIG. 4 shows a case in which the drum support 128 supports the front cover 22, but the drum support 128 may support a circumferential surface of the drum body 21.

Figure 5:
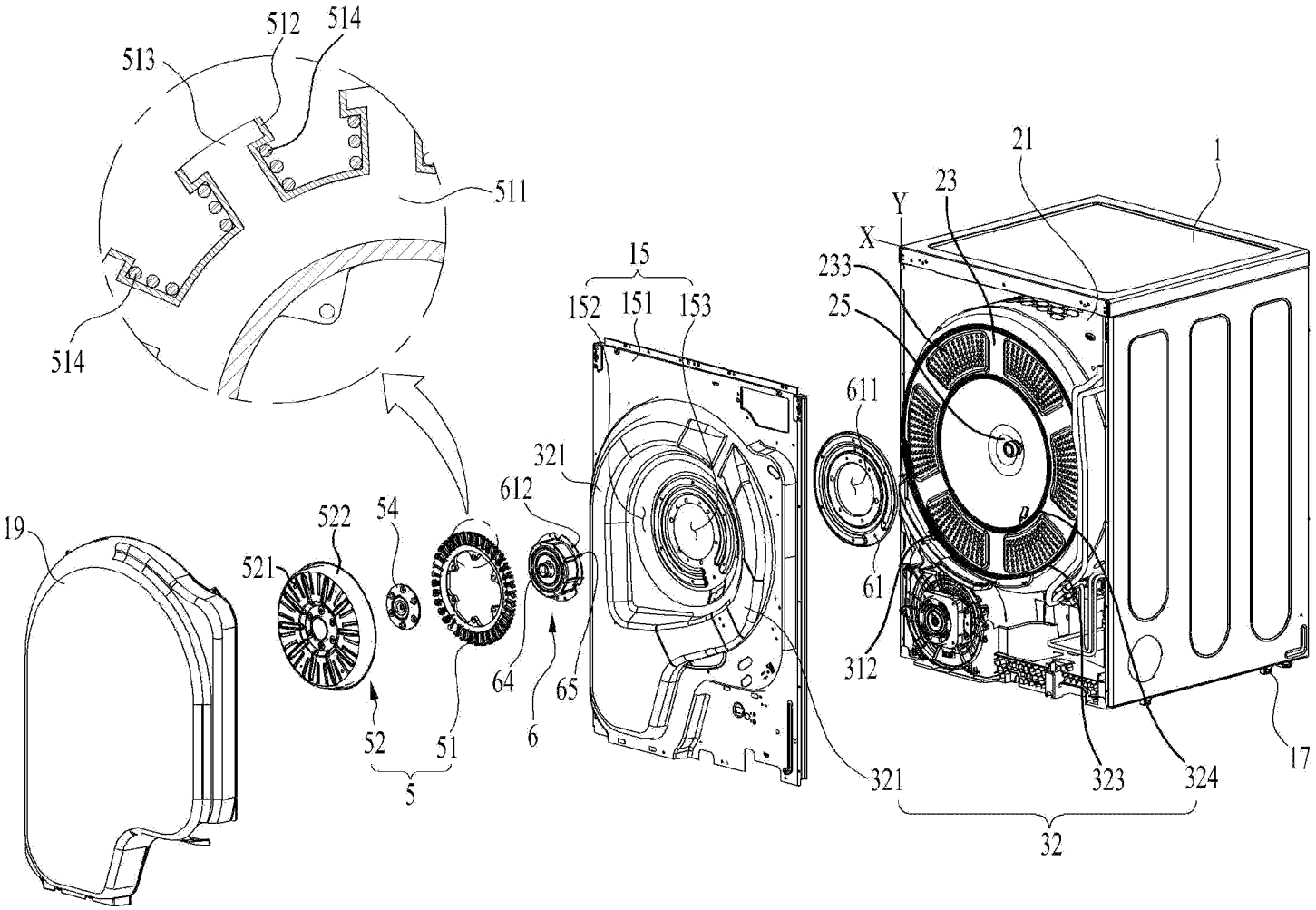
FIG. 5 shows an example of a fixed panel.

The second body support 15 may be formed as a fixed panel 151 fixed to the cabinet 1 so as to be located at a point spaced apart from the rear cover 23. FIG. 5 shows a case in which the fixed panel 151 is fixed to the base panel 17 to form a rear surface of the laundry treating apparatus 100 (a rear surface of the cabinet) as an example.

The fixed panel 151 may have a driver mounting groove 152 defined therein that provides a space for a motor 5 to be mounted. The driver mounting groove 152 may be defined as a groove in which the fixed panel 151 is bent concavely toward the rear cover 23 of the drum. The fixed panel 151 has a fixed panel through-hole 153 through which a shaft (an output shaft) that rotates the drum 2 extends. The fixed panel through-hole 153 may be located inside the driver mounting groove 152.

As described above, when the drum 2 has the drum body 21, the front cover 22 fixed to the drum body, and the rear cover 23 fixed to the drum body, rigidity of the drum increases compared to a structure in which the open front surface and rear surface of the drum body 21 are rotatably connected to the support panel 121 and the fixed panel 151, respectively. As the rigidity of the drum increases, deformation of the drum body 21 may be minimized when the drum rotates, which may minimize a problem in which the laundry is caught in a space between the drum body and the support panel and a space between the drum body and the fixed panel when the drum body 21 is deformed (a load of the motor may be minimized).

As shown in FIG. 4, the dryer 3 may include an exhaust passage 31 connected to the exhaust port 126, a supply passage 32 that guides air supplied from the exhaust passage 31 to the drum body 21, and a heat exchanger 34 disposed inside the exhaust passage 31 to sequentially dehumidify and heat air.

The exhaust passage 31 may include a first duct 311 connected to the exhaust port 126, a second duct 312 connected to the supply passage 32, and a third duct 313 that connects the first duct 311 with the second duct 312. The third duct 313 may be fixed to the base panel 17.

The heat exchanger 34 may be constructed as various apparatuses that may sequentially dehumidify and heat air flowed into the exhaust passage 31. FIG. 4 shows a case in which the heat exchanger 34 is constructed as a heat pump as an example. That is, the heat exchanger 34 includes a first heat exchanging apparatus (a heat absorber) 341 that removes moisture from air introduced into the exhaust passage 31, a second heat exchanging apparatus (a heater) 343 that is disposed inside the exhaust passage 31 and heats air that has passed through the heat absorber 341, and a fan 349 that causes air discharged from the drum 2 to sequentially pass through the heat absorber and the heater and then move to a supply duct 32.

The heat absorber 341 and the heater 343 are sequentially arranged along a flow direction of air and are connected to each other via a refrigerant pipe 348 that forms a circulation path for a refrigerant. The refrigerant flows along the refrigerant pipe 348 by a compressor 345 located outside the exhaust passage 31, and the refrigerant pipe 348 has a pressure regulator 347 that regulates a pressure of the refrigerant.

As shown in FIG. 5, the air inlet 233 defined in the rear cover 23 of the drum may be defined as multiple holes are arranged to surround a center of the rear cover 23 (the center of rotation of the drum). In this case, the supply passage 32 may include a supply duct 321 disposed on the fixed panel 151 to form a flow path of air discharged from the second duct 312, and a first flow path forming portion 323 and a second flow path forming portion 324 that guide air inside the supply duct 321 to the air inlet 233.

The supply duct 321 may form the flow path (the flow path of air) by bending in a direction in which the fixed panel 151 is away from the rear cover 23. Additionally, the supply duct 321 may be formed in a ring shape surrounding the driver mounting groove 152, and an outlet of the second duct 312 may be connected to a circumferential surface of the supply duct 321.

The first flow path forming portion 323 may be disposed to surround an outer circumferential surface of a ring formed by the air inlets 233 (a circumferential surface with a greater diameter among two circumferential surfaces of the ring), and the second flow path forming portion 324 may be disposed to surround an inner circumferential surface of the ring formed by the air inlets 233 (a circumferential surface with a smaller diameter among the two circumferential surfaces of the ring).

The first flow path forming portion 323 and the second flow path forming portion 324 may be fixed to the rear cover 23 or to the supply duct 321. FIG. 5 shows a case in which the flow path forming portions 323 and 324 are fixed to the rear cover 23 as an example.

In FIG. 5, a free end of the first flow path forming portion 323 surrounds the outer circumferential surface of the flow path (the ring-shaped flow path) formed by the supply duct 321, and a free end of the second flow path forming portion 324 surrounds the inner circumferential surface of the flow path formed by the supply duct 321. The first flow path forming portion 323 and the second flow path forming portion 324 may be made of rubber, felt, or the like.

The motor 5 that generates power necessary for the rotation of the drum 2 includes a stator 51 that is located in the driver mounting groove 152 and generates a rotating field, and a rotor 52 that rotates by the rotating field. The rotating motion of the rotor 52 is transmitted to the drum 2 via the power transmitter 6 fixed to the fixed panel 151, and the stator 51 is fixed to at least one of the fixed panel 151 or the power transmitter 6.

To prevent the motor 5 located in the driver mounting groove 152 from being exposed to the outside (to improve durability of the motor and prevent safety accidents by preventing exposure of the motor to an external environment), the fixed panel 151 may further include a cover panel 19 that prevents the motor 5 from being exposed to the outside. Furthermore, the cover panel 19 may be formed in a shape that may also prevent the supply duct 321 from being exposed to the outside (a shape that surrounds the supply duct). This is not only to minimize heat escaping to the outside of the supply duct 321, but also to prevent safety accidents that may occur when a body comes into contact with the supply duct 321.

The stator 51 includes a ring-shaped core 511 with a through-hole (a core through-hole) defined at a center thereof, multiple support bars 513 radially protruding from an outer circumferential surface of the core 511, an insulator 512 that insulates the core and the support bar, and a coil 514 disposed to surround the support bar 513.

The rotor 52 may include a disk-shaped rotor body 521, a rotor circumferential surface 522 that extends from an edge of the rotor body 521 toward the fixed panel 515 to define a space in which the stator 51 is accommodated, and multiple permanent magnets 523 fixed to the rotor circumferential surface 522 such that N and S poles are alternately exposed.

Figure 6:
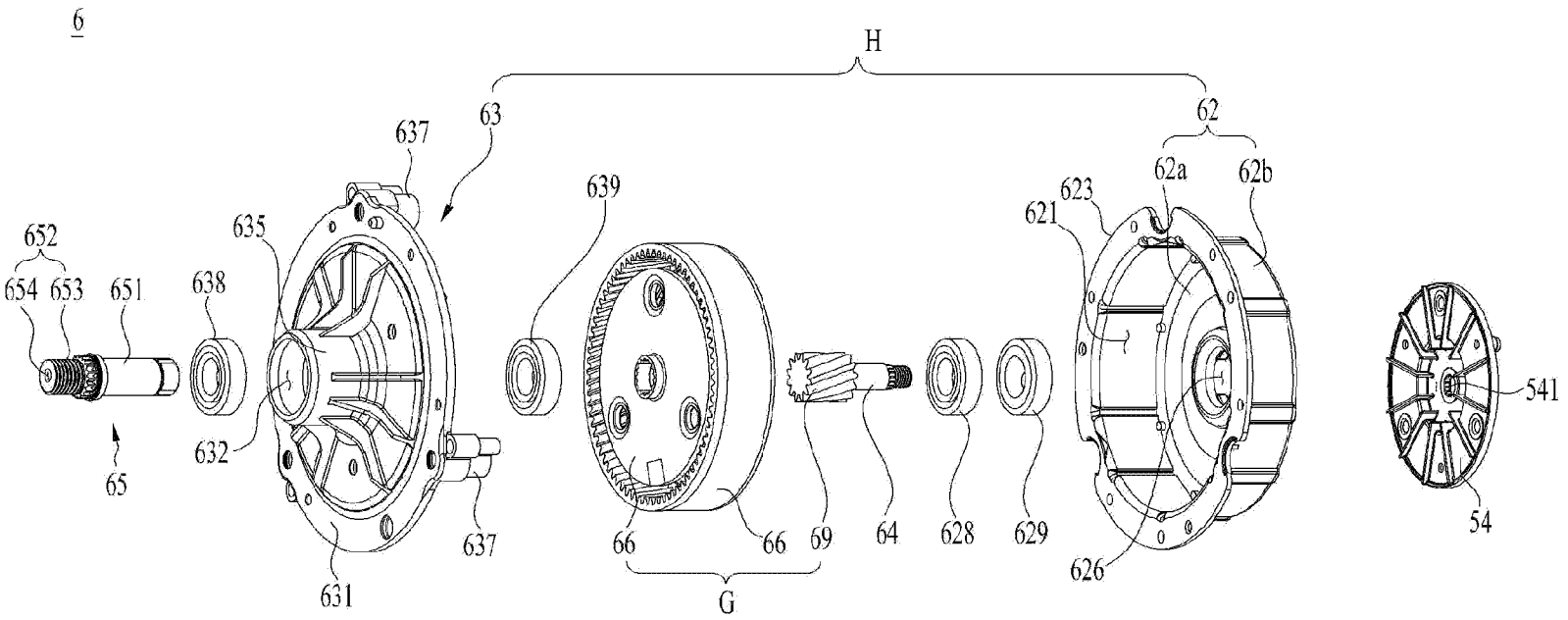
FIGS. 6 and 7 show an example of a power transmitter.

FIG. 6 shows an example of the power transmitter 6 that connects the rotor 52 with the rear cover 23 of the drum.

The power transmitter 6 includes a housing H fixed to the fixed panel 151, an input shaft 64 rotatably fixed to a bottom surface (a surface facing a direction in which the rotor is located) of the housing H, an output shaft 65 rotatably fixed to a top surface (a surface facing a direction in which the fixed panel is located) of the housing H, and a gear unit G that is disposed inside the housing and transmits the rotating motion of the input shaft 64 to the output shaft 65.

The input shaft 64 may have one end fixed to the rotor 52 and the other end formed as a shaft located inside the housing H, and the output shaft 65 may have one end fixed to the rear cover 23 and the other end formed as a shaft located inside the housing H. The gear unit G connects one end of the input shaft 64 located inside the housing H with one end of the output shaft 65 located inside the housing.

The housing H may be fixed to the fixed panel 151 and located in a space (outside the cabinet) separated from a space in which the drum 2 is located (inside the cabinet). This is to improve the durability of the power transmitter 6 by minimizing transfer of heat inside the cabinet (heat emitted from the drum or the dryer) to the inside of the housing H.

The input shaft 64 may be coupled to the rotor body 521 via a shaft fixer 54. The shaft fixer 54 may include a shaft fixing hole 543 to which one end of the input shaft 64 is fixed.

The output shaft 65 is inserted into the fixed panel through-hole 153 and connected to the rear cover 23. The rear cover 23 may have a shaft fastening portion 25 to which the output shaft 65 is fixed. This is to distribute a stress acting on the center of the rear cover 23 when the output shaft 65 rotates. A specific structure of the shaft fastening portion 25 will be described later.

To minimize deformation of the fixed panel 151, the housing H may be fixed to the fixed panel 151 via a transmitter bracket 61 and a housing fastener 612.

As shown in FIG. 5, the transmitter bracket 61 may include a bracket through-hole 611 through which the output shaft 65 passes, and the housing fastener 612 may be formed as a bolt that connects the housing H with the transmitter bracket 61. The transmitter bracket 61 may be made of the same material as the fixed panel 151, or may be made of a material with a higher strength than that of the fixed panel 151.

As shown in FIG. 6, the housing H may include a housing body 62 formed in a hollow cylindrical shape and having an open hole defined in a surface facing the fixed panel 151, and a housing cover 63 that is fixed to the housing body 62 and closes the open hole.

The housing body 62 may define an accommodating space 621 in which the gear unit G is mounted. The accommodating space 621 may be formed via a housing base **62*a* on which the input shaft 64 is fixed, and a housing circumferential surface 62*b* extending from an edge of the housing base 62*a* toward the housing cover 63**.

Figure 7:
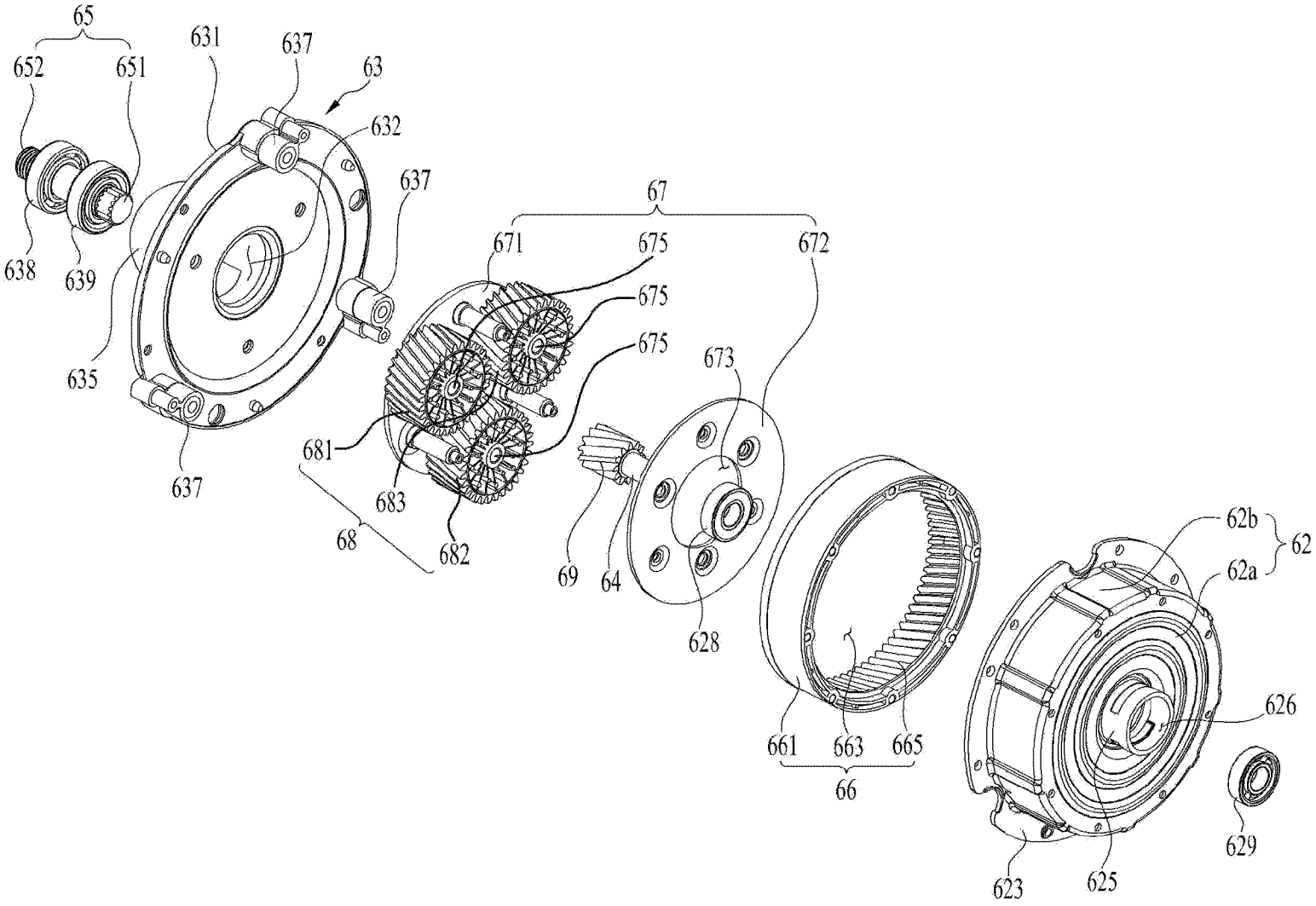

As shown in FIG. 7, the housing body 62 has an input shaft support 625 extending from the housing base **62*a* toward the rotor 52. The input shaft support 625 may be formed as a pipe surrounding an input shaft through-hole 626 extending through the housing body 62**.

The input shaft 64 inserted into the input shaft through-hole 626 is rotatably fixed to the input shaft support 625 via input shaft bearings 628 and 629. The input shaft bearings may include an input shaft first bearing 628 that is fixed to the input shaft support 625, and an input shaft second bearing 629 that is fixed inside the input shaft through-hole 626 and located between the input shaft first bearing 628 and the rotor 52.

The housing cover 63 may be formed in any shape that may open and close the open hole defined in the housing body 62. FIG. 7 shows a case in which the housing cover 63 is formed as a disk-shaped cover body 631 as an example. The housing cover 63 may be fixed to the housing body 62 via a cover fixing plate 623 disposed on the housing circumferential surface **62*b***.

The housing cover 63 may include an output shaft through-hole 632 defined to extend through the cover body 631, and a pipe-shaped output shaft support 635 that extends from the cover body 631 toward the fixed panel 151 and surrounds the output shaft through-hole 632.

The output shaft support 635 may include output shaft bearings 638 and 639 that rotatably fix the output shaft 65 to the output shaft through hole 632.

The output shaft bearing may include an output shaft first bearing 638 and an output shaft second bearing 639 that are fixed to the output shaft support portion 635 and located inside the output shaft through hole 631.

The gear unit G may include a ring gear 66 fixed to the housing circumferential surface **62*b* and located in the accommodating space 621, a driving gear 69 fixed to the input shaft 64 and located inside the accommodating space 621, a cage 67 located inside the accommodating space 622 and to which the other end of the output shaft 65 is fixed, and a driven gear 68 rotatably fixed to the cage 67 to connect the driving gear 69 with the ring gear 66**.

The ring gear 66 may include a gear body 661 fixed to the housing circumferential surface **62 *b*, a gear body through-hole 663 defined to extend through the gear body, and gear teeth 665** disposed along an inner circumferential surface of the gear body.

The cage 67 may include a first base 671 located inside the gear body through-hole 663 and to which one end of the output shaft 65 is fixed, a second base 672 located inside the gear body through-hole 663 and having a base through-hole 673 defined at a center thereof, and a connecting shaft 675 that connects the first base with the second base and forms a rotation shaft of the driven gear 68. Because the output shaft 65 is fixed to the first base 671, whether the output shaft 65 rotates is determined depending on whether the cage 67 rotates.

The driven gear 68 may be composed of multiple gears rotatably fixed to the connecting shaft 675. In the drawing, a case in which the driven gear is composed of a first driven gear 681, a second driven gear 682, and a third driven gear 683 is shown as an example.

The input shaft 64 is inserted into the base through-hole 673 to be coaxial with the output shaft 65, and gear teeth disposed on the driving gear 69 are located in a space defined between the driven gears and are engaged with gear teeth of the driven gears 681, 682, and 683.

Figure 8:
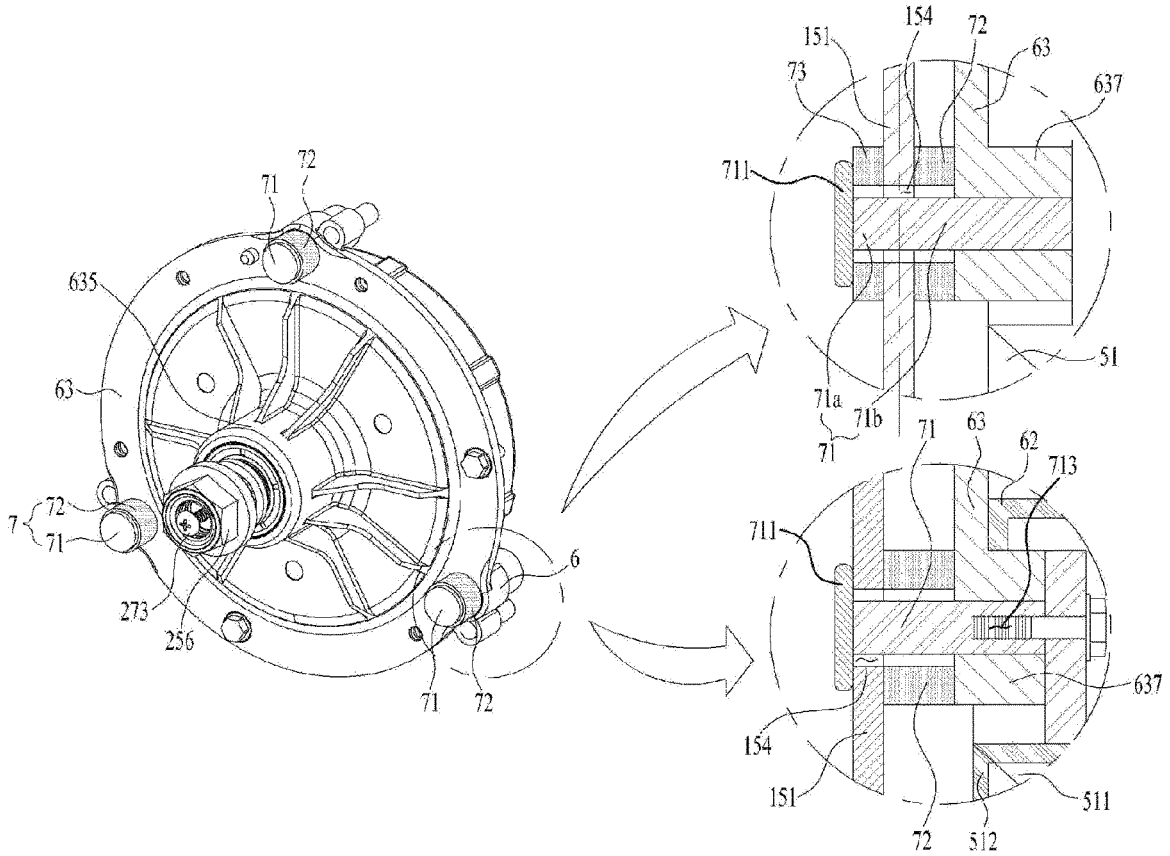
FIGS. 8, 9, and 10 illustrate an example of a coupling structure of a power transmitter, a fixed panel, and a drum.

As shown in FIG. 8, the above-described power transmitter 6 and stator 51 may be fixed to the fixed panel 151 through a mounting unit 7.

The mounting unit 7 includes a mounting body 71 inserted into a guide hole 154 provided in the fixed panel 151. The mounting body 71 may be provided as a bar that is inserted into the guide hole 154 and reciprocates along a direction perpendicular to the fixed panel 151.

The mounting body 71 inserted into the guide hole 154 is divided into a first region 71*a* located in a space provided with the rear cover 23 and a second region 71*b* located at an opposite side to the first region (a space provided with the rotor).

The mounting unit 7 includes a head 711 that is fixed to the mounting body 71 and located in the first region 71*a*. The head 711 is a component that prevents the mounting body 71 from being separated from the fixed panel 151 when the mounting body 71 moves toward a position at which the rotor 52 is located. The head 711 may be provided as a disk with a diameter longer than a diameter of the guide hole 154.

Figure 9:
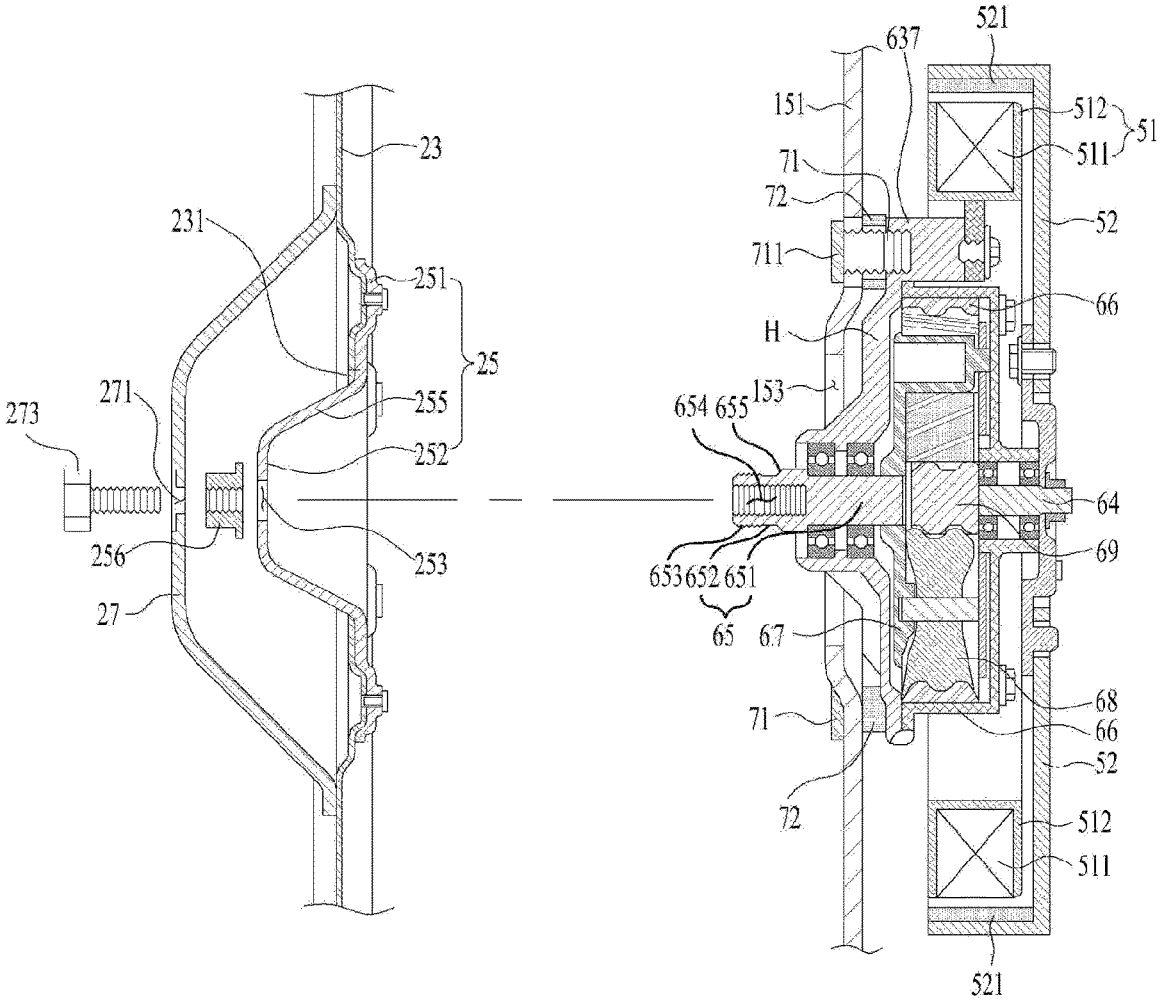

The above-described power transmitter 6 is fixed to the second region 71*b* of the mounting body. As shown in FIG. 9, the housing cover 63 may include a mounting body fixing unit 637, and the mounting body fixing unit 637 may be fixed to the second region 71*b* of the mounting body. The mounting body fixing unit 637 may be provided in plural pieces (the same number as the mounting bodies) along a circumferential surface of the cover body 631.

In this case, the stator 51 may be fixed to the housing H or fixed to the second region 71*b* of the mounting body. FIG. 9 shows an example in which the stator 51 is fixed to a free end of the mounting body 71 through a stator fixing bolt connecting the insulator 512 to the mounting body 71. A fixing hole 713 to which the stator fixing bolt is fastened may be provided in a free end of the mounting body.

The mounting unit 7 includes a first displacement limiter 72 that limits a displacement in which the housing H moves toward the fixed panel 151. The first displacement limiter 72 may be provided in the second region 71*b* of the mounting body and located between the fixed panel 151 and the housing H.

The first displacement limiting portion 72 may be provided in various structures to limit a displacement in which the housing H moves toward the fixed panel 151. FIG. 9 illustrates a case in which the first displacement limiter 72 is provided as an elastic body such as rubber, and FIG. 10 illustrates a case in which the first displacement limiter 72 is provided as a spring.

In the first displacement limiter 72 of FIG. 9, a ring-shaped elastic body is provided to surround a circumferential surface of the mounting body 71 and is located between the fixed panel 151 and the mounting body fixing unit 637.

Figure 10:
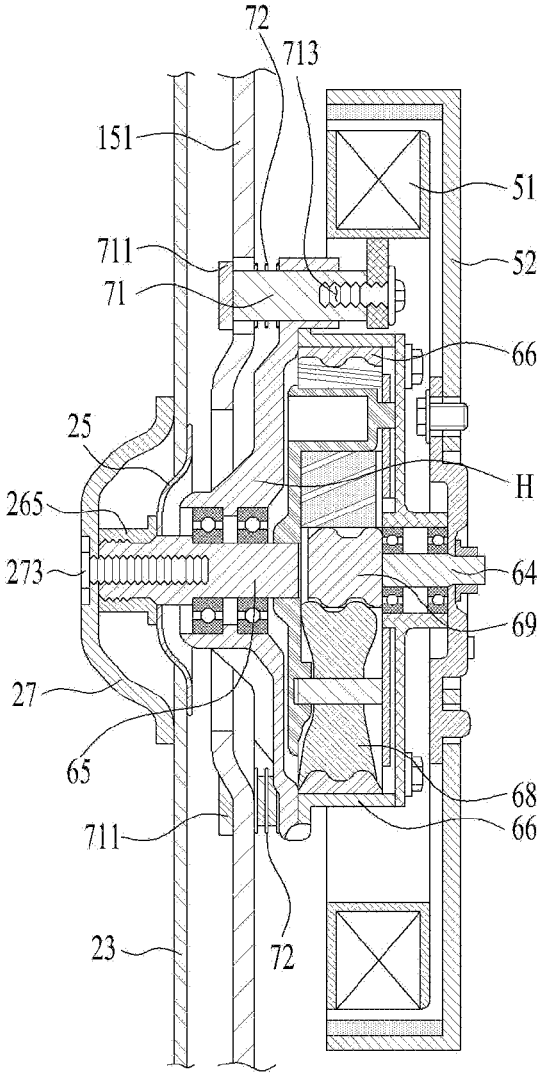

The first displacement limiter 72 of FIG. 10 may be provided to surround the circumferential surface of the mounting body 71, one end of the spring may be fixed to the fixed panel 151, and the other end of the spring may be fixed to the mounting body fixing unit 637.

The number of the mounting bodies 71 may be two or more, and the mounting bodies 71 may be disposed to be apart from each other by the same angle with respect to the fixed panel through-hole 153. FIG. 8 illustrates an example in which three mounting bodies 71 are provided, and the mounting bodies 71 need to be located at positions spaced 120 degrees apart from each other with respect to the fixed panel through-hole 153.

In this case, the same number of mounting body fixing units 637 as the mounting bodies 71 may be provided in the housing H, and the first displacement limiter 72 may be provided in each mounting body 71.

As shown in FIG. 8, the mounting portion 7 may further include a second displacement limiter 73 disposed between the head 711 and the fixed panel 151 to limit a displacement in which the head 711 moves toward the fixed panel 151 (a displacement in which the housing moves away from the fixed panel).

The second displacement limiter 73 may be provided in the first region 71*a* of the mounting body and may be provided as an elastic body or a spring located between the head 711 and the fixed panel 151.

An operation process of the above-described power transmitter 6 is as follows. When the rotor 52 rotates, the input shaft 64 rotates. When the driving gear 69 rotates by the input shaft 64, the driven gears 681, 682, and 683 located between the driving gear 69 and the ring gear 66 also rotate. Because the driven gears 681, 682, and 683 are engaged with the ring gear 66 fixed to the housing body 62, when the driven gear 68 rotates, the cage 67 and the output shaft 65 rotate, and thus the drum 2 fixed to the output shaft 65 will also rotate.

The above-described mounting unit 7 may reduce or suppress forward vibration of the drum 2 (a displacement in which the drum moves toward the support panel) and backward vibration (a displacement in which the drum moves toward the fixed panel) that may occur during rotation.

When the drum 2 moves toward the support panel 121, the housing H connected to the drum through the output shaft 65 moves toward the fixed panel 151. When the housing H moves toward the fixed panel 151, the first displacement limiter 72 is compressed by the mounting body fixing unit 637. When the first displacement limiter 72 is compressed, the force for moving the drum 2 forward is attenuated, and a moving range of the drum 2 and the housing H may be limited.

On the contrary, when the drum 2 moves toward the fixed panel 151, the housing H may move in a direction away from the fixed panel 151. When the housing H moves in a direction away from the fixed panel 151, the second displacement limiter 73 is compressed by the head 711. When the second displacement limiter 73 is compressed, the force for moving the drum 2 backward is attenuated, and a moving range of the drum 2 and the housing H may be limited.

In the laundry treating apparatus 100 having the above-described structure, the housing H and the stator 51 are fixed to the fixed panel 151 through the mounting portion 7, and the rotor 52 is fixed to the housing H through the input shaft 64. Therefore, the above-described stator 51 and the rotor 52 vibrate together with the housing H, and thus the laundry treating apparatus 100 has an advantageous effect in maintaining the coaxiality of the input shaft 64 and the output shaft 65.

As mentioned above, to distribute the stress acting on the center of the rear cover 23 when the output shaft 65 rotates (to minimize a decrease in durability of the rear cover) and minimize a decrease in durability of the power transmitter 6, the output shaft 65 is connected to the rear cover 23 of the drum via the shaft fastening portion 25.

As shown in FIG. 9, the rear cover 23 may have a rear cover through-hole 231, and the shaft fastening portion 25 may include a first fastening body 251 fixed to the rear cover 23, a connecting body 255 extending from the first fastening body 251 and inserted into the rear cover through-hole 231, and a second fastening body 252 fixed to the connecting body 255 and located inside the drum 2. The second fastening body 252 includes a fastening portion through-hole 253 defined therein into which the output shaft 65 is inserted.

The output shaft 65 includes a fastening shaft 651 located inside the housing H and fixed to the cage 67, and a fixed shaft 652 extending from the fastening shaft 651 and inserted into the fastening portion through-hole 253.

A screw thread 653 is disposed on a circumferential surface of the fixed shaft 652. Accordingly, the nut 256 is coupled to one end 652 of the output shaft that passes through the fastening portion through-hole 253 to fix the output shaft 65 to the shaft fastening portion 25.

Assembly of the drum 2 and the output shaft 65 is performed via a process of fixing the fixed panel 151 on which the power transmitter 6 is mounted to the base panel 17, a process of inserting the output shaft 65 into the fastening portion through-hole 253, a process of fixing a location of the front cover 22 by fixing the support panel 121 to the base panel 17, and a process of coupling the output shaft 65 with the shaft fastening portion 25 via the nut 256.

Before fixing the support panel 121 to the base panel 17, the output shaft 65 is maintained inserted into the fastening portion through-hole 253, but the front cover is not supported by the drum support 128. However, the output shaft 65 is simply inserted into the fastening portion through-hole 253, and thus the front cover 22 may be temporarily maintained to be accommodated on an upper surface of the exhaust passage 31 or the base 17. Accordingly, when the drum 2 and the output shaft 65 are assembled, the shaft fastening portion 25 shown in FIG. 9 may minimize a load of the drum 2 from being transmitted to the output shaft 65, thereby minimizing degradation of the durability (output shaft bearing damage, cage damage, ring gear damage, and the like) of the power transmitter 6.

A diameter of the connecting body 255 decreases in a direction from the first fastening body 251 to the second fastening body 252. When a shape of the connecting body 255 is as described above, the fixed shaft 652 may be guided along the fastening portion through-hole 253 along a surface of the connecting body 255. Therefore, the laundry treating apparatus 100 may shorten a time of fixing the output shaft 65 to the shaft fastening portion 25.

To prevent the above-described shaft fastening portion 25 from being exposed into the drum 2, the drum 2 may further include the fastening portion cover 27. As shown in FIG. 9, the fastening portion cover 27 may be formed in any shape that may close the rear cover through-hole 231 and prevent the exposure of the shaft fastening portion 25. The fastening portion cover 27 may be fixed to the output shaft 65 by a bolt 273 that is inserted into the cover through-hole 271 and fixed to the fastening groove 654 of the fixed shaft 652.

The laundry treating apparatus described above may be modified and implemented in various forms, and thus the scope of rights of the present disclosure is not limited to the above-described embodiments.

The invention claimed is:

1. A laundry treating apparatus comprising:

a drum including a drum body providing a space for storing laundry therein, a front cover forming a front surface of the drum body, a rear cover forming a rear surface of the drum body, and a drum inlet formed to pass through the front cover;

a fixed panel apart from the rear cover and including a guide hole;

a mounting body inserted into the guide hole, reciprocating in a direction perpendicular to the fixed panel, and is divided into a first region facing a position at which the rear cover is located and a second region located at an opposite side to the first region based on the fixed panel;

a head provided in the first region and configured to prevent the mounting body from being separated from the fixed panel;

a power transmitter including a housing fixed to the second region, an input shaft with one end located outside the housing and another end located inside the housing, an output shaft with one end formed to pass through the fixed panel and fixed to the rear cover and another end located inside the housing, and a gear unit located inside the housing and configured to transmit a rotating motion of the input shaft to the output shaft;

a stator fixed to the second region or the housing to form a rotating field;

a rotor fixed at one end of the input shaft and rotated by the rotating field; and a first displacement limiter provided in the second region to be located between the fixed panel and the housing and configured to limit a displacement in which the housing moves toward the fixed panel.

2. The laundry treating apparatus of claim 1, wherein the first displacement limiter includes rubber.

3. The laundry treating apparatus of claim 1, wherein the first displacement limiter includes a spring.

4. The laundry treating apparatus of claim 3, wherein one end of the spring is fixed to the fixed panel, and another end of the spring is fixed to the housing.

5. The laundry treating apparatus of claim 1, wherein two or more mounting bodies are provided, and the mounting bodies are apart from each other by a constant angle with respect to a through hole of the fixed panel.

6. The laundry treating apparatus of claim 5, wherein the first displacement limiter is one of first displacement limiters, and a number of the first displacement limiters is equal to a number of the mounting bodies.

7. The laundry treating apparatus of claim 1, further comprising a second displacement limiter provided in the first region, located between the head and the fixed panel, and configured to limit a displacement in which the housing moves away from the fixed panel.

8. The laundry treating apparatus of claim 7, wherein the second displacement limiter includes rubber or a spring.

9. The laundry treating apparatus of claim 1, further comprising:

a rear cover through hole formed to pass through the rear cover;

a shaft fastening portion fixed to the rear cover to close the rear cover through hole and including a first fastening body fixed to the rear cover, a second fastening body located within the drum, a fastening portion through-hole provided in the second fastening body, and a connecting body inserted into the rear cover through hole and connecting the first fastening body to the second fastening body, wherein the fastening portion through-hole is formed to pass through the shaft fastening portion and into which one end of the output shaft is inserted; and a nut coupled to one end of the output shaft formed to pass through the fastening portion through-hole and configured to fix the output shaft to the shaft fastening portion.

10. The laundry treating apparatus of claim 9, wherein a diameter of the connecting body is set to decrease toward the second fastening body from the first fastening body.

11. The laundry treating apparatus of claim 10, further comprising a fastening portion cover located within the drum to close the rear cover through hole and configured to prevent the shaft fastening portion from being exposed into the drum.

12. The laundry treating apparatus of claim 11, further comprising:

a cover through hole formed to pass through the fastening portion cover;

a fastening groove provided in the output shaft; and a bolt inserted into the cover through hole, fixed to the fastening groove, and configured to fix the fastening portion cover to the output shaft.

* * * * *